US005878794A

United States Patent [19]

Somers

[11] Patent Number: 5,878,794

[45] Date of Patent: Mar. 9, 1999

[54] BATCH INCLUSION PACKAGE FOR AMORPHOUS POLYOLEFINS AND PROCESS FOR ITS PREPARATION

[75] Inventor: Marc Stacey Somers, Longview, Tex.

[73] Assignee: Eastman Chemical Company, Kingsport, Tenn.

[21] Appl. No.: 785,681

[22] Filed: Jan. 21, 1997

[51] Int. Cl.[6] ..... B65B 1/04

[52] U.S. Cl. ..... 141/82; 141/11; 141/1; 53/440

[58] Field of Search ..... 141/1, 11, 69, 141/82; 53/127, 440, 452; 264/255, 266, 268

[56] References Cited

U.S. PATENT DOCUMENTS

| | | |
|---|---|---|
| 3,564,808 | 2/1971 | Kent . |
| 3,923,758 | 12/1975 | Carter . |
| 3,954,697 | 5/1976 | McConnell . |
| 4,748,796 | 6/1988 | Viel . |
| 5,109,892 | 5/1992 | Somers . |
| 5,160,686 | 11/1992 | Thaler . |
| 5,292,468 | 3/1994 | Colombani . |
| 5,307,608 | 5/1994 | Muir . |
| 5,401,455 | 3/1995 | Hatfield ..... 264/255 |

FOREIGN PATENT DOCUMENTS

| | | |
|---|---|---|
| 1584601 | 12/1969 | France . |
| 2608560 | 6/1988 | France . |
| 1511577 | 8/1993 | Germany . |

*Primary Examiner*—Steven O. Douglas
*Attorney, Agent, or Firm*—Jonathan D. Wood; Harry J. Gwinnell

[57] ABSTRACT

A process for packaging normally tacky amorphous polyolefins, and other materials having similar melt viscosities, is provided. The process entails flowing a heated material into a molded polyolefin container having a minimum wall thickness of about 0.1 mm to less than 0.24 mm at a temperature above the melting point of the container, followed by slowly cooling the filled container. The process is conducted at ambient conditions without the use of cooling fluids.

19 Claims, No Drawings

BATCH INCLUSION PACKAGE FOR AMORPHOUS POLYOLEFINS AND PROCESS FOR ITS PREPARATION

FIELD OF THE INVENTION

The present invention relates to a process for packaging amorphous polyolefins or other similar viscosity thermoplastic materials. The present invention more particularly relates to a process of packaging amorphous polyolefins, or other similar thermoplastic materials, into a thin-wall polyolefin container that is later melt blended with the contents in its end use.

BACKGROUND OF THE INVENTION

Amorphous polyolefins (APOs) are well known and are very useful in adhesives, roofing compositions, cable flooding, caulks and sealants. APOs are produced and transferred or shipped in many forms for incorporation into final compositions. APOs are generally tacky at room temperature and have a low degree of crystallinity and are therefore, not easily formed into powders or pellets for shipment.

The manufacturers of APOs, and other thermoplastic materials having similar melt viscosities, have struggled with finding an economical and practical way of delivering these raw materials to compounders or end users in a form that is generally easily manageable and cost efficient. There have been serious shortcomings in finding practical transportation means and user-friendly packaging for APOs. Many compounders and end users are not equipped to handle tank cars of bulk molten material. Small solid APO slats coated with a non-tacky substance are more useable, but are much more expensive due to high production processing costs. The form most economical to use is solid APO blocks packaged in release coated paper. However, the unwrapping and handling of a solid APO block is very labor intensive and generates substantial paper waste.

There have been several processes aimed at providing useful solid forms of low viscosity hot-melt, thermoplastic products such as hot-melt adhesives, APOs and asphalt compositions that do not require unwrapping. U.S. Pat. No. 4,748,796 (1988) discloses an elaborate process of solidifying adhesive compositions in molds which are coated with an electrostatically held screen of powder. U.S. Pat. No. 5,160,686 (1992) discloses another process involving complicated machinery for blowing a hot gas curtain between a polypropylene mold and a stream of hot-melt-blown hydrogenated castor oil designed to coat a molten hot melt adhesive as it solidifies.

U.S. Pat. No. 5,109,892 (1992) discloses a process wherein a rigid free-standing thick walled (0.25–4 mm) polyolefin container is filled with molten APO without melting, even though the container has a melting point below the temperature at which the molten APO is flowed into the container. U.S. Pat. No. 5,109,892 discloses that the relationship between the maximum fill temperature and the container thickness for that process is demonstrated by the linear equation wherein the fill temperature is preferably less than about Y° C., wherein Y equals 0.34 times the melting point of the container material (°C.), times the minimum wall thickness of the container (mm), plus 143. For packaging of APOs in polyolefin containers at flowable fill temperatures, this equation limits container thickness to no less than about 0.25 mm.

The process of U.S. Pat. No. 5,109,892 is attractive since there are no wasteful molds or elaborate cooling methods required. However, the polyolefin container has provided too great of a percentage of polyolefin when the APO or other similar viscosity thermoplastic material and container are melted together for end use. Also, thicker walled molded containers are relatively more expensive to make than thin walled molded containers.

Since then, alternate processes using thin walled containers have been disclosed and require very elaborate and expensive equipment. U.S. Pat. No. 5,292,468 (1994) discloses a process involving spinning nozzles which spray a complex protective web of non-pressure sensitive adhesive into the interior of a mold prior to filling with hot melt adhesive.

U.S. Pat. No. 5,307,608 (1994) discloses a process for packaging asphalt wherein a floatable mold is lined with a 0.025 to 0.45 mm polypropylene or polyethylene film required to have a melting point higher than the molten fill temperature. The small percentage of container material in the solid package is very useful. But the disclosed process requires an elaborate conveyor driven cooling system to keep the container material from melting.

U.S. Pat. No. 5,401,455 (1995) discloses another process using a thin (0.0025–0.125 mm) polyethylene based non-rigid film requiring a mold and either a heat sink or refrigerant to keep the thin film from melting.

In light of the above, it would be very desirable to be able to cheaply produce APOs or materials having similar melt viscosities in a solid non-tacky form having a small percentage of packaging which can be melted along with the material being packaged. It would further be desirable to have a process utilizing a thin walled container requiring no waste while requiring no heat sinks or elaborate cooling equipment.

SUMMARY OF THE INVENTION

The present process for packaging thermoplastic materials comprises:

(a) supplying, at a flowable temperature, a thermoplastic material having a Brookfield Thermosel Viscosity of about 1 to 200,000 milliPascal-seconds (mPa.s) at 190° C.;

(b) flowing said thermoplastic material into a molded polyolefin container having a minimum wall thickness of about 0.1 mm to less than 0.25 mm wherein the material of said polyolefin container has a melting point below the temperature at which said thermoplastic material is flowed into the polyolefin container; and (c) slowly cooling the filled polyolefin container;

wherein said process is conducted at ambient conditions.

Another aspect of the present invention is a process for packaging thermoplastic materials comprising:

(a) supplying, at a flowable temperature, a thermoplastic material having a Brookfield Thermosel Viscosity of about 1 to 200,000 milliPascal-seconds (mPa.s) at 190° C.;

(c) contacting a molded polyolefin container having a minimum wall thickness of at least 0.1 mm, wherein the material of said polyolefin container has a melting point below the temperature at which said thermoplastic material is flowed into the container, with a metal heat sink;

(c) flowing said thermoplastic material into said polyolefin container while said polyolefin container is in contact with said metal heat sink; and (d) slowly cooling the filled polyolefin container while remaining in contact with said metal heat sink;

wherein said process is conducted at ambient conditions.

DESCRIPTION OF THE INVENTION

The applicant has unexpectedly discovered that an APO, or other similar viscosity thermoplastic material, can be flowed into a molded polyolefin container having a wall thickness of as little as 0.1 mm at a temperature above the melting point of the container material, without the need for an elaborate cooling of the outside surface of the filled container.

The process of the present invention is particularly surprising in view of U.S. Pat. No. 5,109,892 (1992) which discloses a clear linear mathematical relationship which establishes that the minimum wall thickness of a molded polyolefin container which will resist melting under flowable APO temperatures at ambient processing temperatures is about 0.25 mm. Therefore, it was most surprising to find that thinner polyolefin containers having a minimum thickness from about 0.1 mm to below 0.25 mm could be used for molten filling of APOs under ambient processing conditions.

The process of the present invention is further surprising in view of U.S. Pat. No. 5,401,455 (1995) which teaches a process for packaging hot melt adhesives wherein the flexible ethylene-based polyolefin containers having wall thicknesses typically up to 0.125 mm are supported by molds which must be in contact with a refrigerant gas or liquid heat sink to prevent the polyolefin container from melting under fill temperatures which are even lower than typical APO fill temperatures. However, the process of the present invention is conducted at ambient conditions using no elaborate forms of cooling such as refrigerated gas and cooling pools.

A further unexpected aspect of the present invention is the increased difference attainable between the fill temperature and the melting point of the polyolefin container, without melting the polyolefin container, when the present process is conducted with the polyolefin container being in contact with a metal heat sink such as a metal pail. While previous processes have disclosed using cooling methods such as liquid heat sinks and refrigerant gas to dissipate heat from the container walls, there have been no disclosures teaching that a metal substrate would dissipate heat from thin polyolefin container walls. In fact, previous patents disclosing use of molds for supporting flexible liners for hot melt filling disclose that it is critical that the molds be cooled by elaborate means such as a cooling pool.

The batch inclusion packaging process of the present invention is conducted at ambient conditions and includes supplying an APO, or other thermoplastic material having a Brookfield Thermosel Viscosity of about 1 to 2000,000 mPa.s at a flowable temperature into a molded polyolefin container having a minimum wall thickness of about 0.1 mm to less than 0.25 mm, wherein the polyolefin container material has a melting point below the temperature at which the thermoplastic material is flowed into the container. The present process also includes slowly cooling the filled container at ambient processing temperatures. The container does not melt under the flowable fill temperatures required for the process of the present invention.

The APOs and other thermoplastic materials packaged according to the process of the present invention are normally soft and tacky at about room temperature, solidify slowly and have a low degree of crystallinity. The process of the present invention can be used to package any low viscosity hot-melt thermoplastic product such as APOs, waxes, hot-melt adhesives, asphalt compositions and the like.

The thermoplastic materials packaged by the present process are meltable and preferably have a Ring and Ball Softening Point (RBSP) between about 80° C. and 160° C., and a Brookfield Thermosel Viscosity between about 1 and 200,000 milliPascal-second (mPa.s) at 190° C. (1 Centipoise (cP) is equivalent to 1 mPa.s). These thermoplastic materials more preferably have a RBSP between about 100° C. and 160° C. and a Brookfield Thermosel Viscosity between about 10 and 100,000 mPa.s at 190° C. with a RBSP between about 120° C. and 160° C. and a Brookfield Thermosel Viscosity between about 20 and 50,000 mPa.s at 190° C. being most preferable.

The preferred thermoplastic materials to be packaged by the present process are APOs. Suitable APOs packaged by the present process include, for example, poly-alpha-olefins and amorphous copolymers and terpolymers. The more preferred APOs are amorphous polypropylenes and amorphous copolymers of propylene and at least one other alpha olefin such as ethylene, 1-butene, 1-hexene or 1-octene. Such APOs are known in the art and are disclosed in U.S. Pat. No. 3,954,697 and U.S. Pat. No. 3,923,758, the disclosures of which are incorporated herein by reference in their entireties.

The thin wall molded polyolefin container is preferably prepared from polyolefins that are compatible with asphalt and polymer blends. These polyolefin materials are preferably selected from the group consisting of polypropylene homopolymers, ethylene-propylene copolymers, impact copolymers, filled polypropylenes and polypropylene blended with another compatible polymer such as polypropylene-polyethylene blends. The container is more preferably made from polypropylene homopolymers.

Ethylene based polyolefins are less preferred container materials for packaging APO and asphalt compositions. High density polyethylene (HDPE) can be used as the thin wall molded plastic container, but its compatibility with asphalt and APO is questionable. Low density (LDPE) and linear low density polyethylene (LLDPE) can also be used, but the lower melting points of these materials would require either filling temperatures lower than that normally used to flow APO or asphalt or some elaborate means of cooling such as a water bath or water spray. However, such ethylene based thin wall containers would have more suitability in the present process when packaging other materials such as certain low softening point adhesives.

Except where specified otherwise, the thin wall molded polyolefin container of the present process is freestanding. The term "freestanding", as used herein, means not only that the container is capable of standing alone due to it's rigidity, but it also means that it is not in contact with any other objects which could dissipate heat such as heat sinks.

The thin wall molded polyolefin container of the process of the present invention is flexible yet rigid enough to stand unsupported by other means, preferably a cylindrical container such as a pail liner. No wasteful mold is required for filling these containers. That is a benefit to this process since most molds have only a limited number of uses under such fill temperatures. Molded polyolefin containers of this type inherently have different wall thicknesses at different points along the container wall. These containers are most commonly described by their nominal wall thickness, which is the average thickness as measured by several different areas. However, it is the thinnest point on the container walls which limits the integrity of the container upon being filled with hot molten material.

The thin wall molded polyolefin container has a minimum wall thickness, or thinnest point, of about 0.10 mm to less than 0.25 mm, preferably about 0.15 mm to 0.20 mm. The maximum wall thickness of the thin wall molded plastic container is preferably about 2.0 mm, with a maximum wall thickness of about 1.0 mm being most preferable.

The wall thickness of the container is preferably kept to a minimum. A container having a thicker wall than necessary will be more costly to produce and take longer to melt in the final application. A thicker wall container is also more difficult to mold using low cost molding techniques such as vacuum molding or thermoforming.

The thin wall molded polyolefin container can have dimensions of any size, but preferably has an outer diameter or width of about 10 to 100 cm, having a volume of about 1 to 250 liters. The thin wall molded polyolefin container more preferably has an outer diameter of about 15 to 70 cm and a volume of about 5 to 70 liters.

The molded thin wall polyolefin container used in the present invention is made of a material that has a melting point below the fill temperature at which the thermoplastic material is flowed into the container. The thin wall molded polyolefin container preferably has a temperature gradient ($\Delta T$) across the container wall between about 0.1° to 50° C. per 0.1 mm when filled at room temperature. The preferred melting point of the container is equal to a temperature between 1° and 50° C. below the temperature at which the thermoplastic material is flowed into the container. The melting point of the container material is more preferably a temperature between 1° and 25° C. below the fill temperature. A container having a melting point closer to the fill temperature is typically more useful. However, the container material chosen should depend on the end use of the batch inclusion package.

The term "room temperature" for present purposes is defined as ambient processing temperatures between about 22° C. and 35° C. The process of the present invention is preferably carried out at room temperature. However, it is an important aspect of the process of the present invention is conducted as ambient conditions. Ambient conditions is defined herein as ambient processing conditions wherein the polyolefin container is not in contact with fluid cooling means such as a refrigerant gas or liquid heat sinks such as cooling pools in order to keep the polyolefin container from melting.

Conducting the present process at room temperature, the melting point of the container material should be no lower than 50° C. below the fill temperature. However, if the present process is conducted at ambient temperatures less than about 22° C. the melting point of the container material can be as low as 70° C. below the fill temperature.

The molten, or flowable thermoplastic material can be flowed into a singular container. However, it is preferred that the molten, or flowable material be flowed into a plurality containers as this will increase production rates and lower production costs.

The rate at which these thin wall molded polyolefin containers are filled with the flowable thermoplastic material is preferably between about 1 and 150 kilograms per minute per container. The fill rate is more preferably between about 2 and 50 kilograms per minute per container and most preferably between 4 and 40 kilograms per minute per container.

Once the thin wall molded polyolefin container is filled with the flowable or molten thermoplastic material, the container is allowed to cool slowly at ambient conditions. Methods of elaborate cooling such as a water bath are not required. When the filled thin wall molded polyolefin container is allowed to cool at ambient conditions, the container should not have any significant contact with other containers (except at the lip) containing molten material for about 8 to 24 hours. In other words, the filled containers should not be stacked until the APO or other similar viscosity thermoplastic material has cooled. These containers are more preferably isolated from significant contact with other containers for at least about 8 hours.

The molten thermoplastic material in the thin wall molded polyolefin container is preferably cooled as fast as possible without resorting to complicated cooling means. The cooling rate is preferably at about 0.05° C. to 0.45° C. per minute. The final cooled temperature required prior to contact with other containers will be determined according to the particular thermoplastic material. A generally useful final cooling temperature is a core temperature of about 100° C.

The term "flowable temperature" as used herein simply refers to the temperature at which the thermoplastic material must reach in order to have enough flowability to be delivered at a reasonable rate. The rate is preferably between 1 to 150 kilograms per minute per container.

The flowable temperature at which the thermoplastic material is flowed into the freestanding thin wall molded polyolefin container is preferably less than about Y° C., wherein Y=2.7 times the melting point (Tm) of the thin wall molded polyolefin container in degrees celsius, times its nominal wall thickness in millimeters (mm), plus 25, according to formula (I) below:

$$Y=(2.7*Tm*\text{nominal wall thickness})+25 \quad \text{(I)}$$

wherein Tm is degrees celsius, and thickness is in mm, and the nominal wall thickness is calculated as the average thickness of the container wall.

In the preferred process of the present invention, wherein a thermoplastic material is delivered into a polyolefin container, the flowable temperature is preferably about 110° to 215° C., more preferably about 160° to 215° C. The thermoplastic material is generally heated or maintained at an elevated temperature in a heated vessel prior to being flowed into the molded polyolefin container. This vessel is preferably a heated storage container to which amorphous polyolefin is transferred to during the polymerization reaction.

The present invention also includes an alternate process for packaging thermoplastic materials using a metal heat sink. This alternate process comprises flowing a thermoplastic material having a Brookfield Thermosel Viscosity of about 1 to 200,000 milliPascal-seconds (mPa.s) at 190° C. into a molded polyolefin container having a minimum wall thickness of at least 0.1 mm wherein the material of said polyolefin container has a melting point below the temperature at which said thermoplastic material is flowed into the container, and wherein the polyolefin container is in contact with a metal heat sink. This alternate process also includes slowly cooling the filled polyolefin container while remaining in contact with said metal heat sink. This alternate process is also conducted at ambient conditions.

In the alternate process of the present invention wherein a metal heat sink is used, the minimum wall thickness of the polyolefin container is preferably about 0.1 mm to less than 0.25 mm, more preferably about 0.15 mm to 0.20 mm.

The flowable temperature at which the APO or other similar viscosity thermoplastic material is flowed into the thin wall molded polyolefin container in contact with a metal or other similar heat sink is preferably less than about Y° C., wherein Y=2.65 times the melting point (Tm) of the thin wall molded polyolefin container in degrees celsius, times its nominal wall thickness in millimeters (mm), plus 47.7, according to formula (II) below:

$$Y=(2.65*Tm*\text{nominal wall thickness})+47.7 \quad \text{(II)}$$

wherein Tm is in degrees celsius, thickness is in mm, and the nominal wall thickness is calculated as the average thickness of the container wall.

Employment of a heat sink material with a thermal conductivity greater than about 11 cal/m*°C.*s (calories/meter*degree*second), the thermal conductivity of steel, will allow even greater fill temperatures than given by equation (II). Materials such as aluminum, copper and silver would be examples of such materials. However, heat sink materials do not have to be limited to metals. The alternate process of the present invention is preferably conducted by placing the polyolefin container inside a metal container such as a metal pail.

The mathematical relationships shown by formulas (I) and (II) above are generally linear and represent a fill temperature below which the thin wall molded polyolefin container will not melt.

The use of a lid is not required. However, if the container is cooled with water, a lid or cover is generally required prior to cooling.

The preferred type of fill apparatus generally includes conventional quick opening valves that are manually, mechanically, hydraulically or pneumatically controlled and include for example butterfly valves. Other more sophisticated filling apparatus may be used such as gravimetric or volumetric type filling devices.

The molten thermoplastic material cools as it flows towards the wall of the container. The hottest point of the filled container is the center of the container of molten material. The molten material resting against the inside wall of the container is generally at a temperature higher than the melting point of the thin wall molded polyolefin container, but does not melt the polyolefin container material in the process of the present invention since there is an adequate ΔT across the container wall. However, should the outside wall temperature of the thin wall molded polyolefin container surpass the melting point of the container material, the container will soften and melt at that point. Thus, care must be taken to avoid significant contact with other hot containers. Also, the container should not be overfilled since hot molten material flowing down the outside of the thin wall molded polyolefin container would significantly decrease the ΔT across the container wall, allowing the outside of the container to reach its melting point, thereby melting the container.

The present invention includes a batch inclusion package comprising a molded polyolefin container containing a solid block of thermoplastic material essentially filling the void of the container wherein the polyolefin of the molded container has a melting point below the flowable temperature of said thermoplastic material and the container has a minimum wall thickness of about 0.1 mm to less than 0.25 mm. This batch inclusion package can be melted for end use without the need to separate the container from the contents.

The following examples illustrate the present invention and are not intended to limit the reasonable scope thereof.

EXAMPLES

The melting point of the container materials used in the Examples was determined by differential scanning calorimetry (DSC), according to ASTM D3418.

EXAMPLE 1

This Example illustrates some of the limits of the process of the present invention. One of the less preferred polyolefin container materials, low density polyethylene (LDPE), was used. This Example illustrates the importance of the particular polyolefin container material and the importance of using a container material having a melting point which is not too far below the fill temperature.

A vacuum formed low density polyethylene (LDPE) 5-gallon (18.9 liter) pail liner was placed inside of a 5-gallon (18.9 liter) metal pail, then filled with a molten amorphous propylene-ethylene (APE) copolymer at a fill temperature of 143° C. The APE has a typical viscosity of 300 mPa.s (milliPascal-seconds) at 190° C., and a typical specific heat value (Cp) between about 0.38 to 0.67 calories/gram/°C. between 20° C. and 185° C.

The APE was taken from a storage tank where it had been held in a hot molten state at approximately 190° C. and transferred into a 5-gallon (18.9 liter) metal pail. The APE was then allowed to cool to 143° C. before being poured into the metal pail containing the LDPE pail liner.

The LDPE liner had a nominal thickness of 0.38 mm, and a typical DSC melting point of about 108° C. The fill rate of the APE into the pail was about 18 kilograms per minute. Pail and liner dimensions were about 30 cm in diameter by 34 cm tall. The ambient processing temperature was 25° C.

The 143° C. APE fill temperature melted the LDPE liner while setting in the metal pail. The fill temperature was 35° C. higher than the melting point of the container. This was too great a difference in fill temperature for a thin wall LDPE container, even though a heat sink was used.

EXAMPLE 2

This Example further illustrates the importance of not using a fill temperature which exceeds the melting point of the container by too much. The fill temperature exceeded the melting point of the high density polyethylene (HDPE) container by 31° C.

A vacuum formed HDPE 5-gallon (18.9 liter) pail liner having a wall thickness varying between 0.14 mm and 0.64 mm, and a nominal thickness of 0.38 mm, was filled with molten amorphous propylene-ethylene (APE) copolymer at a temperature of 162° C. The HDPE liner dimensions were about 30 cm in diameter by 35 cm tall. The HDPE liner's DSC peak melting point temperature was measured at about 131° C. The APE had a measured viscosity of 2,410 mPa.s at 190° C. and has a typical specific heat value (Cp) between about 0.38 to 0.67 calories/gram/°C. between 20° C. and 185° C.

The APE was melted and homogenized in a heated and stirred vessel. The heating unit was used to control the temperature of the molten APE. When at the desired temperature, the APE was pumped into the 5-gallon (18.9 liter) HDPE pail liner at a rate of about 5 kilograms per minute using a heat traced gear pump. The ambient processing temperature was 22° C.

The 162° C. APE fill temperature melted the freestanding HDPE liner. No heat sink was used.

EXAMPLE 3

This Example shows the process of the present invention wherein the fill temperature exceeded the melting point of the container material by 25° C., but did not melt the container.

A vacuum formed high density polyethylene (HDPE) 5-gallon (18.9 liter) pail liner having a wall thickness varying between 0.14 mm and 0.64 mm, and a nominal thickness of 0.38 mm, was filled with molten amorphous propylene-ethylene (APE) copolymer at a fill temperature of 156° C. The HDPE liner dimensions were about 30 cm in diameter by 35 cm tall. The HDPE liner's DSC peak melting point temperature was measured at about 131° C. The APE had a measured viscosity of 2,410 mPa.s at 190° C. and has a typical specific heat value (Cp) between about 0.38 to 0.67 calories/gram/°C. between 20° C. and 185° C.

The APE was melted and homogenized in a heated and stirred vessel. The heating unit was used to control the temperature of the molten APE. When at the desired temperature, the APE was pumped into the 5-gallon (18.9 liter) HDPE pail liner at a rate of about 5 kilograms per minute using a heat traced gear pump. The ambient processing temperature was 22° C.

The 156° C. APE fill temperature did not melt the freestanding HDPE liner. No heat sink was used.

EXAMPLE 4

This Example further illustrates the limits of the process of the present invention. In this Example, the container was melted by a fill temperature exceeding the melting point of the container by 53° C., even though a heat sink was used.

A vacuum formed high density polyethylene (HDPE) 5-gallon (18.9 liter) pail liner was placed inside of a 5-gallon (18.9 liter) metal pail, then filled with a molten amorphous propylene-ethylene (APE) copolymer at a temperature of 184° C. The APE had a measured viscosity of 2,410 mPa.s at 190° C. and has a typical specific heat value (Cp) between about 0.38 to 0.67 calories/gram/°C. between 20° C. and 185° C.

The APE was melted and homogenized in a heated and stirred vessel. The heating unit was used to control the temperature of the molten APE. When at the desired temperature, the APE was pumped into the 5-gallon (18.9 liter) HDPE pail liner at a rate of about 5 kilograms per minute using a heat traced gear pump. The ambient processing temperature was 22° C.

The HDPE liner had a wall thickness varying between 0.14 mm and 0.64 mm, and a nominal thickness of 0.38 mm. The HDPE liner dimensions were about 30 cm in diameter by 35 cm tall and it's DSC peak melting point temperature was measured at about 131° C.

The 184° C. APE fill temperature melted the HDPE liner while setting in the metal pail.

EXAMPLE 5

This Example illustrates the present process wherein a fill temperature exceeding the melting point of the container by 43° C. did not melt the container when a heat sink was used.

A vacuum formed high density polyethylene (HDPE) 5-gallon (18.9 liter) pail liner was placed inside of a 5-gallon (18.9 liter) metal pail, then filled with a molten amorphous propylene-ethylene (APE) copolymer at a temperature of 174° C. The APE had a measured viscosity of 2,225 mPa.s at 190° C. and has a typical specific heat value (Cp) between about 0.38 to 0.67 calories/gram/°C. between 20° C. and 185° C.

The APE was melted and homogenized in a heated and stirred vessel. The heating unit was used to control the temperature of the molten APE. When at the desired temperature, the APE was pumped into the 5-gallon (18.9 liter) HDPE pail liner at a rate of about 4 kilograms per minute using a heat traced gear pump. The ambient processing temperature was about 23° C.

The HDPE liner had a thickness varying between 0.14 mm and 0.64 mm, and a nominal thickness of 0.38 mm. The HDPE liner dimensions were measured at about 30 cm in diameter by 35 cm tall and it's DSC peak melting point temperature was measured at about 131° C.

The 174° C. APE fill temperature did not melt the HDPE liner while setting in the metal pail.

EXAMPLE 6

This Example illustrates the limits of the present process. The polypropylene container was melted by a fill temperature exceeding the melting point of the container by 29° C. when a heat sink was not used.

A vacuum formed polypropylene (PP) 5-gallon (18.9 liter) pail liner having a thickness varying between 0.18 mm and 0.66 mm, and a nominal thickness of 0.38 mm, was filled with molten amorphous propylene-ethylene (APE) copolymer at a temperature of 189° C. The PP liner dimensions were about 30 cm in diameter by 34 cm tall. The PP liner's DSC peak melting point temperature was measured at about 160° C. The APE had a measured viscosity of 2,290 mPa.s at 190° C. and has a typical specific heat value (Cp) between about 0.38 to 0.67 calories/gram/°C. between 20° C. and 185° C.

The APE was melted and homogenized in a heated and stirred vessel. The heating unit was used to control the temperature of the molten APE. When at the desired temperature, the APE was pumped into the 5-gallon (18.9 liter) PP pail liner at a rate of about 4 kilograms per minute using a heat traced gear pump. The ambient processing temperature was 24° C.

The 189° C. APE fill temperature melted the freestanding PP liner.

EXAMPLE 7

This Example illustrates the present process wherein a polypropylene container was not melted by a fill temperature exceeding the melting point of the container by 24° C., even though a heat sink was not used.

A vacuum formed polypropylene (PP) 5-gallon (18.9 liter) pail liner having a thickness varying between 0.18 mm and 0.66 mm, and a nominal thickness of 0.38 mm, was filled with molten amorphous propylene-ethylene (APE) copolymer at a temperature of 184° C. The PP liner dimension were about 30 cm in diameter by 34 cm tall. The PP liner's DSC peak melting point temperature was measured at about 160° C. The APE had a measured viscosity of 2,290 mPa.s at 190° C. and has a typical specific heat value (Cp) between about 0.38 to 0.67 calories/gram/°C. between 20° C. and 185° C.

The APE was melted and homogenized in a heated and stirred vessel. The heating unit was used to control the temperature of the molten APE. When at the desired temperature, the APE was pumped into the 5-gallon (18.9 liter) PP pail liner at a rate of about 4 kilograms per minute using a heat traced gear pump. The ambient processing temperature was 23° C.

The 184° C. APE fill temperature did not melt the freestanding PP liner.

EXAMPLE 8

This Example further illustrates the limits of the present process by using a fill temperature which exceeded the melting point of the container by 51° C.

A vacuum formed polypropylene (PP) 5-gallon (18.9 liter) pail liner having a thickness varying between about 0.18 mm and 0.66 mm, and a nominal thickness of 0.38 mm, was placed inside of a 5-gallon (18.9 liter) metal pail, then filled with a molten amorphous propylene-ethylene (APE) copolymer at a temperature of 214° C. The APE had a measured viscosity of 1,700 mPa.s at 190° C. and has a typical specific heat value (Cp) between about 0.38 to 0.67 calories/gram/°C. between 20° C. and 185° C.

The APE was melted and homogenized in a heated and stirred vessel. The heating unit was used to control the temperature of the molten APE. When at the desired temperature, the APE was pumped into the 5-gallon (18.9 liter) PP pail liner at a rate of about 8 kilograms per minute using a heat traced gear pump. The ambient processing temperature was 26° C.

The PP liner dimensions were about 30 cm in diameter by 35 cm tall and it's DSC peak melting point temperature was measured at about 163° C.

The 214° C. APE fill temperature melted through the PP liner in spots while setting in the metal pail.

EXAMPLE 9

This Example illustrates the present process wherein a fill temperature exceeding the melting point of the container by 45° C. did not melt the container when a heat sink was used.

A vacuum formed polypropylene (PP) 5-gallon (18.9 liter) pail liner having a thickness varying between about 0.18 mm and 0.66 mm, and a nominal thickness of 0.38 mm, was placed inside of a 5-gallon (18.9 liter) metal pail, then filled with a molten amorphous propylene-ethylene (APE) copolymer at a temperature of 208° C. The APE had a measured viscosity of 3,100 mPa.s at 190° C. and has a typical specific heat value (Cp) between about 0.38 to 0.67 calories/gram/°C. between 20° C. and 185° C.

The APE was melted and homogenized in a heated and stirred vessel. The heating unit was used to control the temperature of the molten APE. When at the desired temperature, the APE was pumped into the 5-gallon (18.9 liter) PP pail liner at a rate of about 5 kilograms per minute using a heat traced gear pump. The ambient processing temperature was about 26° C.

The PP liner dimensions were about 30 cm in diameter by 35 cm tall and it's DSC peak melting point temperature was measured at about 163° C.

The 208° C. APE fill temperature did not melt the PP liner while setting in the metal pail.

EXAMPLE 10

This Example illustrates the process of the present invention wherein a fill temperature exceeding the melting point of the container by 45° C. did not melt the container when a heat sink was used, even with exposure to sun and using a faster fill rate.

A vacuum formed polypropylene (PP) 5-gallon (18.9 liter) pail liner having a wall thickness varying between 0.18 mm and 0.66 mm, and a nominal thickness of 0.38 mm, was placed inside of a 5-gallon (18.9 liter) metal pail, then filled with a molten amorphous propylene-ethylene (APE) copolymer at a temperature of about 205° C. The APE in the storage tank had a measured viscosity of 6,250 mPa.s at 190° C. and has a typical specific heat value (Cp) between about 0.38 to 0.67 calories/gram/°C. between 20° C. and 185° C.

The APE was pumped from the tank into the 5-gallon (18.9 liter) PP pail liner at a rate of about 14 kilograms per minute using a heat traced gear pump. The ambient processing temperature was about 35° C. and the metal pail and the PP liner were exposed to the sun.

The PP liner dimensions were measured at about 30 cm in diameter by 34 cm tall and it's DSC peak melting point temperature was measured at about 160° C.

The 205° C. APE fill temperature did not melt the PP liner while setting in the metal pail.

While the present invention has been described with great detail, variations and modification can be made without departing from the reasonable scope thereof.

I claim:

1. A process for packaging thermoplastic materials comprising:

(a) supplying, at a flowable temperature, a thermoplastic material having a Brookfield Thermosel Viscosity of about 1 to 200,000 milliPascal-seconds (mPa.s) at 190° C.;

(b) flowing said thermoplastic material into a molded polyolefin container having a minimum wall thickness of about 0.1 mm to less than 0.25 mm wherein the material of said polyolefin container has a melting point below the temperature at which said thermoplastic material is flowed into the polyolefin container; and (c) slowly cooling the filled polyolefin container;

wherein said process is conducted at ambient conditions.

2. The process according to claim 1 wherein said polyolefin container is freestanding.

3. The process according to claim 1 wherein said thermoplastic material is an amorphous polyolefin.

4. The process according to claim 1 wherein said thermoplastic material is flowed into said polyolefin container at a temperature between about 110° to 215° C. at a fill rate between about 2 and about 50 kilograms per minute per polyolefin container and is cooled at a rate of about 0.05° to 0.45° C. per minute, based on the core temperature, until reaching a core temperature of about 100° C. or below.

5. The process according to claim 1 wherein the said flowable temperature is less than about y° C. wherein y is equal to 2.7 times the melting point of the polyolefin container material in degrees celsius, times the nominal wall thickness of the polyolefin container in millimeters, plus 25.

6. The process according to claim 1 wherein said polyolefin container is cooled at essentially ambient conditions for about 8 to 24 hours prior to significantly contacting other sources of heat.

7. The process according to claim 1 wherein said polyolefin container material has a melting point equal to a temperature between about 1° to 50° C. below the temperature at which the thermoplastic material is flowed into the polyolefin container.

8. The process according to claim 1 wherein said polyolefin container has an outer diameter of about 10 to 100 cm and a volume of about 1 to 250 liters.

9. The process according to claim 1 wherein the maximum wall thickness of said polyolefin container is no more than about 2 mm.

10. The process according to claim 1 wherein said polyolefin container is made from polyolefins that are compatible with asphalt blends.

11. The process according to claim 10 wherein said polyolefin container is made from a polyolefin selected from the group consisting of polypropylene homopolymers, ethylene-propylene random copolymers, impact copolymers, filled polypropylenes, and polypropylene blends.

12. The process according to claim 11 wherein said polyolefin container is made from polypropylene homopolymers.

13. The process according to claim 1 wherein said thermoplastic material is amorphous polypropylene or amorphous propylene-ethylene copolymer having a ring and ball softening point about 100° to 160° C.

14. The process according to claim 13 wherein said thermoplastic material is amorphous polypropylene or amorphous propylene-ethylene copolymer having a Brookfield Thermosel Viscosity about 10 to 100,000 mPa.s at 190° C.

15. A process for packaging thermoplastic materials comprising:

(a) supplying, at a flowable temperature, a thermoplastic material having a Brookfield Thermosel Viscosity of about 1 to 200,000 milliPascal-seconds (mPa.s) at 190° C.;

(b) flowing said thermoplastic material into a molded polyolefin container having a minimum wall thickness of at least 0.1 mm, wherein the material of said polyolefin container has a melting point below the temperature at which said thermoplastic material is flowed into the container, wherein said polyolefin container is in contact with a metal heat sink;

(c) slowly cooling the filled polyolefin container while remaining in contact with said metal heat sink;

wherein said process is conducted at ambient conditions.

16. The process according to claim 15 wherein said metal heat sink is a metal container and said polyolefin container is placed inside said metal container.

17. The process according to claim 15 wherein said polyolefin container has a minimum wall thickness of about 0.1 mm to less than 0.25 mm.

18. The process according to claim 15 wherein said flowable temperature is less than about y° C. wherein y is equal to 2.65 times the melting point of the container material in degrees celsius, times the nominal wall thickness of the container in millimeters, plus 47.7.

19. A process for packaging thermoplastic materials comprising:

(a) supplying, at a flowable temperature, a thermoplastic material having a Brookfield Thermosel Viscosity of about 1 to 200,000 milliPascal-seconds (mPa.s) at 190° C.;

(b) flowing said thermoplastic material into a molded polyolefin container having a minimum wall thickness of at least 0.1 mm, wherein the material of said polyolefin container has a melting point below the temperature at which said thermoplastic material is flowed into the container, wherein said polyolefin container is in contact with a heat sink having a thermal conductivity of at least about 11 cal/m.°C.s (calories/meter.degree.second);

(c) slowly cooling the filled polyolefin container while remaining in contact with said heat sink;

wherein said process is conducted at ambient conditions.

* * * * *